US006732070B1

(12) United States Patent
Rotola-Pukkila et al.

(10) Patent No.: US 6,732,070 B1
(45) Date of Patent: May 4, 2004

(54) WIDEBAND SPEECH CODEC USING A HIGHER SAMPLING RATE IN ANALYSIS AND SYNTHESIS FILTERING THAN IN EXCITATION SEARCHING

(75) Inventors: Jani Rotola-Pukkila, Tampere (FI); Hannu Mikkola, Tampere (FI); Janne Vainio, Lempäälä (FI)

(73) Assignee: Nokia Mobile Phones, Ltd., Espoo (FI)

( * ) Notice: Subject to any disclaimer, the term of this patent is extended or adjusted under 35 U.S.C. 154(b) by 8 days.

(21) Appl. No.: 09/505,411

(22) Filed: Feb. 16, 2000

(51) Int. Cl.[7] ..... G10L 19/06
(52) U.S. Cl. ..... 704/219; 704/220
(58) Field of Search ..... 704/219, 220, 704/222, 223, 230, 262, 265

(56) References Cited

U.S. PATENT DOCUMENTS

| | | | | | |
|---|---|---|---|---|---|
| 3,715,512 | A | * | 2/1973 | Kelly | 704/219 |
| 4,022,974 | A | * | 5/1977 | Kohut et al. | 704/262 |
| 4,330,689 | A | * | 5/1982 | Kang et al. | 704/219 |
| 5,365,553 | A | * | 11/1994 | Veldhuis et al. | 341/200 |
| 5,440,596 | A | * | 8/1995 | Kneepkens et al. | 375/240 |
| 5,455,888 | A | * | 10/1995 | Iyengar et al. | 704/203 |
| 5,581,652 | A | * | 12/1996 | Abe et al. | 704/222 |
| 5,778,335 | A | * | 7/1998 | Ubale et al. | 704/219 |
| 5,937,378 | A | * | 8/1999 | Serizawa | 704/205 |
| 5,950,153 | A | * | 9/1999 | Ohmori et al. | 704/217 |
| 6,014,619 | A | * | 1/2000 | Wuppermann et al. | 704/219 |
| 6,014,621 | A | * | 1/2000 | Chen | 704/219 |
| 6,289,311 | B1 | * | 9/2001 | Omori et al. | 704/268 |

FOREIGN PATENT DOCUMENTS

| | | |
|---|---|---|
| EP | 0 939 394 A | 9/1999 |
| EP | 1 008 984 A | 6/2000 |

OTHER PUBLICATIONS

Paulus et al.; 16 KBIT/S Wideband Speech Coding Based on Unequal Subbands; 1996, IEEE International Conference on, vol. 1, 1696; pp. 255–258.*

"Digital/Analog Voice Demo", http://people/qualcom-m.com/karn/voicedemo/ , Jan., 2000, pp. 1–4.

"Wideband Speech Coding, " http:"//www.umiacs.umd.edu/users/desin/Speech/node2.html, Jan., 2000, p. 1.

"Digital cellular telecommunications system (Phase 2+); Enhanced Full Rate (EFR) speech transcoding; (GSM 06.60 version 7.0.1. Release 1998)", Global System for Mobile Communications, Jul. 1999, pp. 1–47.

Schnitzler, J: "A 13.0 KBIT/S Wideband Speech Codec Based on SB–ACELP", Seattle, WA, 1998, May 12–15, 1998, pp. 157–160, IEEE, NY, NY, USA.

Ubael A et al: "A multi–band CELP wideband speech coder", IEEE International Conference on Acoustics, Speech, and Signal Processing, 1997 IEEE, International Conference on Acoustics, Speech, and Signal Processing, Munich, Germany, vol. 2, Apr. 21–24, 1997, pp. 1367–1370.

Garcia–Mateo C et al, "Application of a low–delay bank of filters to speech coding", IEEE Digital Signal Processing Workshop, Oct. 2–5, 1994, pp. 219–222.

* cited by examiner

*Primary Examiner*—Richemond Dorvil
*Assistant Examiner*—Abul K. Azad
(74) *Attorney, Agent, or Firm*—Ware, Fressola, Van Der Sluys & Adolphson LLP

(57) ABSTRACT

A codec (coder and decoder) in which LP analysis and LP synthesis of a full wideband speech signal is performed, and, in an excitation search part of the coder (searching for a codeword in case of CELP), the signal is divided into a lower band and a higher band with the lower band searched using a decimated target signal obtained by decimating the input speech signal after filtering it through a wideband LP analysis filter. White noise is optionally used for the higher band excitation. In the decoder, the lower band excitation is first interpolated, and then the two excitations (lower band and higher band) are added together and filtered through a wideband LP synthesis filter. Thus, an LP encoding is provided in which the sampling rate used for the search for a lower band excitation is less than the wideband sampling rate used in the LP analysis and synthesis.

22 Claims, 12 Drawing Sheets

WIDEBAND SPEECH CODEC USING A HIGHER SAMPLING RATE IN ANALYSIS AND SYNTHESIS FILTERING THAN IN EXCITATION SEARCHING

FIELD OF THE INVENTION

The present invention relates to the field of coding and decoding synthesized speech. More particularly, the present invention relates to such coding and decoding of wideband speech.

BACKGROUND OF THE INVENTION

Abbreviations

| | |
|---|---|
| A-b-S | Analysis-by-synthesis |
| CELP | Code excited linear prediction |
| HB | Higher band |
| LB | Lower band |
| LP | Linear prediction |
| LPC | Linear predictive coding |
| WB | Wideband |
| LSP | Line spectral pair |

Definitions and Terminology wideband signal: Signal that has a sampling rate of $F_s^{wide}$, often having a value of 16 kHz.

lower band signal: Signal that contains frequencies from 0.0 Hz to $0.5F_s^{lower}$ from the corresponding wideband signal and has the sampling rate of $F_s^{lower}$, for example 12 kHz, which is smaller than $F_s^{wide}$.

higher band signal: Signal that contains frequencies from $0.5F_s^{lower}$ to $0.5F_s^{wide}$ from the corresponding wideband signal and has the sampling rate of $F_s^{higher}$, for example 4 KHz, and usually $F_s^{wide}=F_s^{lower}+F_s^{higher}$.

residual: The output signal resulting from an inverse filtering operation.

excitation search: A search of codebooks for an excitation signal or a set of excitation signals that substantially match a given residual. The output of an excitation search process, conducted by an analysis-by-synthesis module, are parameters (codewords) that describe the excitation signal or set of excitation signals that are found to match the residual. The parameters include two code vectors, one from an adaptive codebook, which includes excitations that are adapted for every subframe, and one from a fixed codebook, which includes a fixed set of excitations, i.e. non-adapted.

x(n) A residual signal (innovation), i.e. a target signal for adaptive codebook search.

exc(n) An excitation signal intended to match the residual x(n).

A(z) The inverse filter with unquantized coefficients. The inverse filter removes short-term correlation from a speech signal. It models an inverse frequency response of the vocal tract of a (real or imagined) speaker.

$\hat{A}(z)$ The inverse filter with quantified (quantized) coefficients.

$H(z)=1/\hat{A}(z)$ A speech synthesis filter with quantified coefficients.

frame: A time interval usually equal to 20 ms (corresponding to 160 samples at an 8 kHz sampling rate). LP analysis is performed frame by frame.

subframe: A time interval usually equal to 5 ms (corresponding to 40 samples at an 8 kHz sampling rate). Excitation searching is performed subframe by subframe.

s(n) An original speech signal (to be encoded).

s'(n) A windowed speech signal.

$\hat{s}(n)$ A reconstructed (by a decoder) speech signal.

h(n) The impulse response of an LP synthesis filter.

LSP a line spectral pair, i.e. the transformation of LPC parameters. Line spectral pairs are obtained by decomposing the inverse filter transfer function A(z) into a set of two transfer functions, each a polynomial, one having even symmetry and the other having odd symmetry. The line spectral pairs are the roots of these polynomials on a z-unit circle. A set of LSP indices are used as one representation of an LP filter.

$T^{ol}$ Open-loop lag (associated with a pitch period, or a multiple or sub-multiple of a pitch period).

$R_w[]$ Correlation coefficients that are used as a representation of an LP filter.

LP coefficients: Generic term for describing short-term synthesis filter coefficients.

short term synthesis filter: A filter that adds to an excitation signal a short-term correlation that models the impulse response of a vocal tract.

perceptual weighting filter: A filter used in an analysis by synthesis search of codebooks. It exploits the noise-masking properties of formants (vocal tract resonances) by weighting the error less near the formant frequencies.

zero-input response: The output of a synthesis filter due to past inputs but no present input, i.e. due solely to the present state of a filter resulting from past inputs.

Discussion

Many methods of coding speech today are based upon linear predictive (LP) coding, which extracts perceptually significant features of a speech signal directly from a time waveform rather than from a frequency spectra of the speech signal (as does what is called a channel vocoder or what is called a formant vocoder). In LP coding, a speech waveform is first analyzed (LP analysis) to determine a time-varying model of the vocal tract excitation that caused the speech signal, and also a transfer function. A decoder (in a receiving terminal in case the coded speech signal is telecommunicated) then recreates the original speech using a synthesizer (for performing LP synthesis) that passes the excitation through a parameterized system that models the vocal tract. The parameters of the vocal tract model and the excitation of the model are both periodically updated to adapt to corresponding changes that occurred in the speaker as the speaker produced the speech signal. Between updates, i.e. during any specification interval, however, the excitation and parameters of the system are held constant, and so the process executed by the model is a linear time-invariant process. The overall coding and decoding (distributed) system is called a codec.

In a codec using LP coding, to generate speech, the decoder needs the coder to provide three inputs: a pitch period if the excitation is voiced; a gain factor; and predictor coefficients. (In some codecs, the nature of the excitation, i.e. whether it is voiced or unvoiced, is also provided, but is not normally needed in case of for example an ACELP codec.) LP coding is predictive in that it uses prediction parameters based on the actual input segments of the speech waveform (during a specification interval) to which the parameters are applied, in a process of forward estimation.

Basic LP coding and decoding can be used to digitally communicate speech with a relatively low data rate, but it produces synthetic sounding speech because of its using a very simple system of excitation. A so-called code excited linear predictive (CELP) codec is an enhanced excitation codec. It is based on "residual" encoding. The modeling of the vocal tract is in terms of digital filters whose parameters are encoded in the compressed speech. These filters are driven, i.e. "excited," by a signal that represents the vibration of the original speaker's vocal cords. A residual of an audio speech signal is the (original) audio speech signal less the digitally filtered audio speech signal. A CELP codec encodes the residual and uses it as a basis for excitation, in what is known as "residual pulse excitation." However, instead of encoding the residual waveforms on a sample-by-sample basis, CELP uses a waveform template selected from a predetermined set of waveform templates in order to represent a block of residual samples. A codeword is determined by the coder and provided to the decoder, which then uses the codeword to select a residual sequence to represent the original residual samples.

FIG. 1A shows elements of a transmitter/encoder system and elements of a receiver/decoder system, the overall system serving as a codec, and based on an LP codec, which could be a CELP-type codec. The transmitter accepts a sampled speech signal s(n) and provides it to an analyzer that determines LP parameters (inverse filter and synthesis filter) for a codec. s(n) is the inverse filtered signal used to determine the residual x(n). The excitation search module encodes for transmission both the residual x(n), as a quantified or quantized error $x_q(n)$, and the synthesizer parameters and applies them to a communication channel leading to the receiver. On the receiver (decoder system) side, a decoder module extracts the synthesizer parameters from the transmitted signal and provides them to a synthesizer. The decoder module also determines the quantified error $x_q(n)$ from the transmitted signal. The output from the synthesizer is combined with the quantified error $x_q(n)$ to produce a quantified value $s_q(n)$ representing the original speech signal s(n).

A transmitter and receiver using a CELP-type codec functions in a similar way, except that the error $x_q(n)$ is transmitted as an index into a codebook representing various waveforms suitable for approximating the errors (residuals) x(n). In the embodiment of a codec shown in FIG. 1A, in case of a CELP-type codec, the synthesis filter $1/\tilde{A}(z)$ can be expressed as:

$$\frac{1}{\tilde{A}(z)} = 1/[1 + a_1 z^{-1} + a_2 z^{-2} + a_3 z^{-3} + \ldots + a_{10} z^{-10}],$$

where the $a_i$ are the unquantized linear prediction parameters.

Problem Addressed by the Present Invention

According to the Nyquist theorem, a speech signal with a sampling rate $F_s$ can represent a frequency band from 0 to $0.5F_s$. Nowadays, most speech codecs (coders-decoders) use a sampling rate of 8 kHz. If the sampling rate is increased from 8 kHz, naturalness of speech improves because higher frequencies can be represented. Today, the sampling rate of the speech signal is usually 8 kHz, but mobile telephone stations are being developed that will use a sampling rate of 16 kHz. According to the Nyquist theorem, a sampling rate of 16 kHz can represent speech in the frequency band 0–8 kHz. The sampled speech is then coded for communication by a transmitter, and then decoded by a receiver. Speech coding of speech sampled using a sampling rate of 16 kHz is called wideband speech coding.

When the sampling rate of speech is increased, coding complexity also increases. With some algorithms, as the sampling rate increases, coding complexity can even increase exponentially. Therefore, coding complexity is often a limiting factor in determining an algorithm for wideband speech coding. This is especially true, for example, with mobile telephone stations where power consumption, available processing power, and memory requirements critically affect the applicability of algorithms.

Sometimes in speech coding, a procedure known as decimation is used to reduce the complexity of the coding. Decimation reduces the original sampling rate for a sequence to a lower rate. It is the opposite of a procedure known as interpolation. The decimation process filters the input data with a low-pass filter and then resamples the resulting smoothed signal at a lower rate. Interpolation increases the original sampling rate for a sequence to a higher rate.

Interpolation inserts zeros into the original sequence and then applies a special low-pass filter to replace the zero values with interpolated values. The number of samples is thus increased.

A prior-art solution is to encode a wideband speech signal without decimation, but the complexity that results is too great for many applications. This approach is called full-band coding.

Another prior-art wideband speech codec limits complexity by using sub-band coding. In such a sub-band coding approach, before encoding a wideband signal, it is divided into two signals, a lower band signal and a higher band signal. Both signals are then coded, independently of the other. (FIG. 4 shows a simplified block diagram of an encoder according to such a prior-art solution.) In the decoder, in a synthesizing process, the two signals are recombined. Such an approach decreases coding complexity in those parts of the coding algorithm (such as the LP coding algorithm) where complexity increases exponentially as a function of the sampling rate. However, in the parts where the complexity increases linearly, such an approach does not decrease the complexity.

The problem with the prior art sub-band coding in which both bands are coded is that the energy of a speech signal is usually concentrated in either the lower band or the higher band. Thus, in coding both bands, using for example a linear predictive (LP) filter to yield quantizations of the signal in each band, the processing by one or the other of the two filters is usually of little value.

The coding complexity of the above sub-band coding prior-art solution can be further decreased by ignoring the analysis of the higher band in the encoder (blocks 42–46) and by replacing it with white noise in the decoder as shown in FIG. 5. The analysis of the higher band can be ignored because human hearing is not sensitive for the phase response of the high frequency band but only for the amplitude response. The other reason is that only noise-like unvoiced phonemes contain energy in the higher band, whereas the voiced signal, for which phase is important, does not have significant energy in the higher band. In this approach, as well as in the above sub-band coding that does not ignore analysis of the higher band in the encoder, the analysis filter models the lower band independently of the upper band. Because of this drastic simplification of the speech encoding and decoding problem, there is for some applications an unacceptable loss of fidelity in speech synthesis.

What is needed is a method of wideband speech coding that reduces-complexity compared to the complexity in coding the full wideband speech signal, regardless of the particular coding algorithm used, and yet offers substantially the same superior fidelity in representing the speech signal.

SUMMARY OF THE INVENTION

Accordingly, the present invention provides a system for encoding an $n^{th}$ frame in a succession of frames of a wideband (WB) speech signal and providing the encoded speech to a communication channel, as well as a corresponding decoder, a corresponding method, a corresponding mobile telephone, and a corresponding telecommunications system. The system for encoding the WB speech signal includes: a WB linear predictive (LP) analysis module responsive to the $n^{th}$ frame of the wideband speech signal, for providing LP analysis filter characteristics; a WB LP analysis filter also responsive to the $n^{th}$ frame of the WB speech signal, for providing a filtered WB speech input; a band-splitting module, responsive to the filtered WB speech input for the $n^{th}$ frame, for splitting the filtered WB speech input into k bands, the band-splitting module for providing a lower band (LB) target signal x(n); an excitation search module responsive to the LB target signal x(n), for providing an LB excitation exc(n); a band-combining module, responsive to the LB excitation exc(n), for providing a WB excitation $exc_w(n)$; and a WB LP synthesis filter, responsive to the LP analysis filter characteristics and to the WB excitation $exc_w(n)$, for providing WB synthesized speech. corresponding telecommunications system. The system for encoding the WB speech signal includes: a WB linear predictive (LP) analysis module (11) responsive to the $n^{th}$ frame of the wideband speech signal, for providing LP analysis filter characteristics; a WB LP analysis filter **(12*a*), also responsive to the $n^{th}$ frame of the WB speech signal, for providing a filtered WB speech input; a band-splitting module (14), responsive to the filtered WB speech input for the $n^{th}$ frame, for splitting the filtered WB speech input into k bands, the band-splitting module for providing a lower band (LB) target signal x(n); an excitation search module (16), responsive to the LB target signal x(n), for providing an LB excitation exc(n); a band-combining module (17), responsive to the LB excitation exc(n), for providing a WB excitation $exc_w(n)$; and a WB LP synthesis filter (18)**, responsive to the LP analysis filter characteristics and to the WB excitation $exc_w(n)$, for providing WB synthesized speech.

In a further aspect of the system of encoding a WB speech signal, the band-splitting module further provides a higher-band (HB) target signal $x_h(n)$, and the system of encoding also includes: an excitation search module, responsive to the HB target signal $x_h(n)$, for providing an HB excitation $exc_h(n)$; and, in addition, the band-combining module is further responsive to the HB excitation $exc_h(n)$.

In a still further aspect of the encoding system, the band-splitting module determines the LB target signal x(n) by decimating the WB target signal $x_w(n)$, and the band-combining module includes a module for interpolating the LB excitation exc(n) to provide the WB excitation $exc_w(n)$.

In one embodiment of this still further aspect of the encoding system, in decimating the WB target signal $x_w(n)$, a decimating delay is introduced that is compensated for by filtering a WB impulse response hw(n) from the end to the beginning of the frame using a decimating low-pass filter that limits the delay of the decimating to one sample per frame, and in interpolating the LB excitation exc(n), an interpolating delay is introduced that is compensated for by using an interpolating low-pass filter that limits the delay of the interpolating to one sample per frame.

The present invention is of use in particular in code excited linear predictive (CELP) type Analysis-by-Synthesis (A-b-S) coding of wideband speech. It can also be used in any other coding methodology that uses linear predictive (LP) filtering as a compression method.

Thus, in the present invention, LP analysis and LP synthesis of the full wideband speech signal is performed. In the excitation search part of the coder (the searching being for a codeword in case of CELP), the signal is divided into a lower band and a higher band. The lower band is searched using a decimated target signal, obtained by decimating the input speech signal after it is filtered through a wideband LP analysis filter as part of the LP analysis. In some embodiments, white noise is used for the higher band excitation because human hearing is not sensitive to the phase of the high frequency band; it is sensitive only to amplitude response. Another reason for using only white noise for the higher band excitation is that only noise-like unvoiced phonemes contain energy in the higher band, whereas the voiced signal, for which phase is important, does not have much energy in the higher band. In the decoder, the lower band excitation is first interpolated, and then the two excitations (the lower band excitation and either white noise or the higher band excitation) are added together and filtered through a wideband LP synthesis filter as part of the LP synthesis process. Such a method of coding keeps complexity low because of searching only the lower band for excitation, but keeps fidelity high because the speech signal is still reproduced over the whole wide frequency band.

BRIEF DESCRIPTION OF THE DRAWINGS

The above and other objects, features and advantages of the invention will become apparent from a consideration of the subsequent detailed description presented in connection with accompanying drawings, in which.

BEST MODE FOR CARRYING OUT THE INVENTION

A speech encoder/decoder system according to the present invention will now be described with particular attention to those aspects that are specific to the present invention. Much of what is needed to implement a speech encoder/decoder system according to the present invention is known in the art, and in particular is discussed in publication GSM 06.60: "Digital cellular telecommunications system (Phase 2+); Enhanced Full Rate (EFR) speech transcoding," version 7.0.1 Release 1998, also known as draft ETSI EN 300 726 v7.0.1 (1999–07). For narrowband speech coding, examples can be found in GSM 06.60 of implementation of the following blocks can be found: high pass filtering; windowing and autocorrelation; Levinson Durbin processing; the $A_w(z) \rightarrow LSP_w$ transformation; LSP quantization; interpolation for subframes; and all blocks of FIG. 9.

Figure 1A:
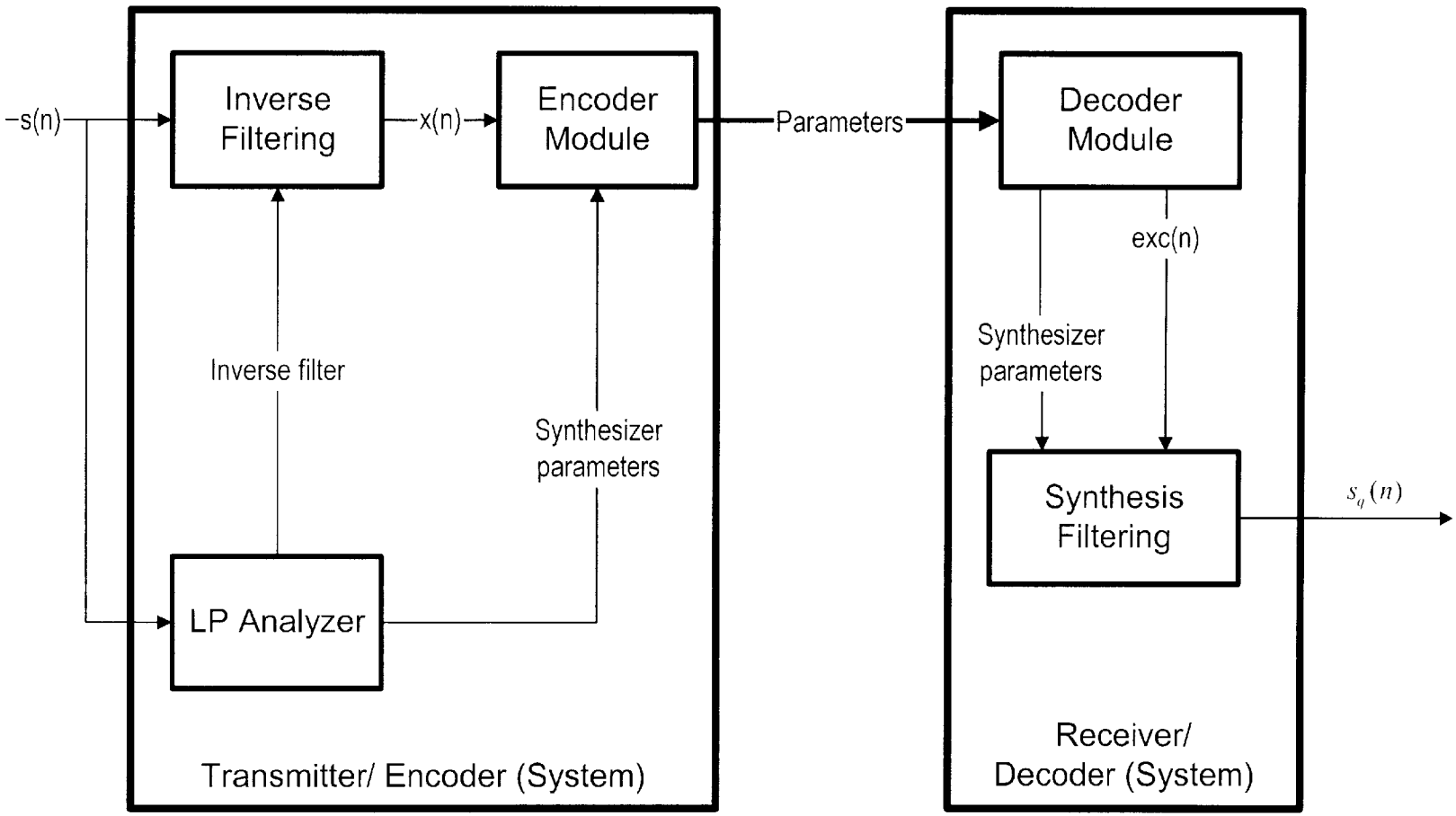
FIG. 1A is a simplified block diagram of a transmitter and receiver using a linear predictive (LP) encoder and decoder.
Figure 1B:
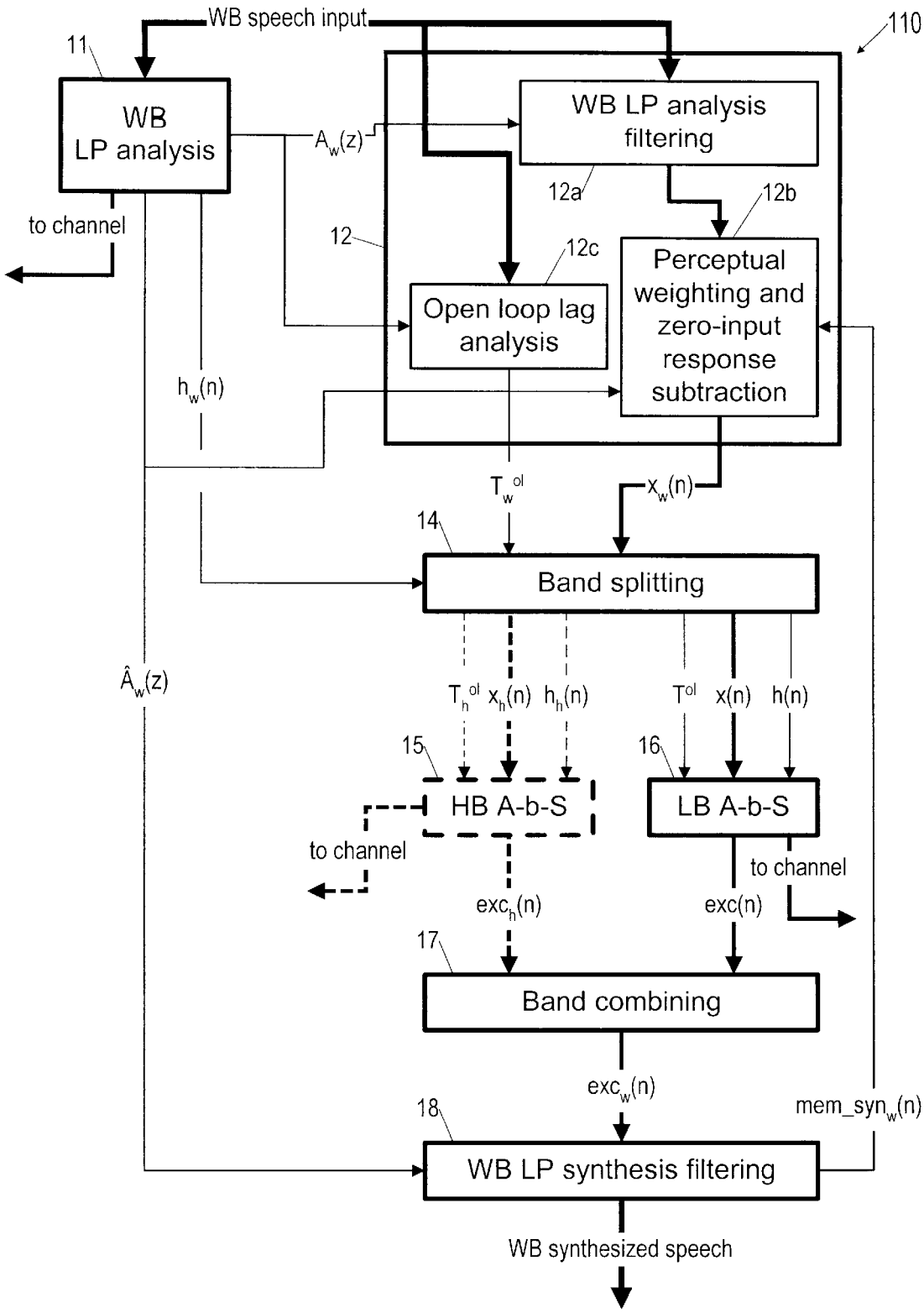
FIG. 1B is a simplified block diagram of the CELP speech encoder according to the invention.
Figure 7:
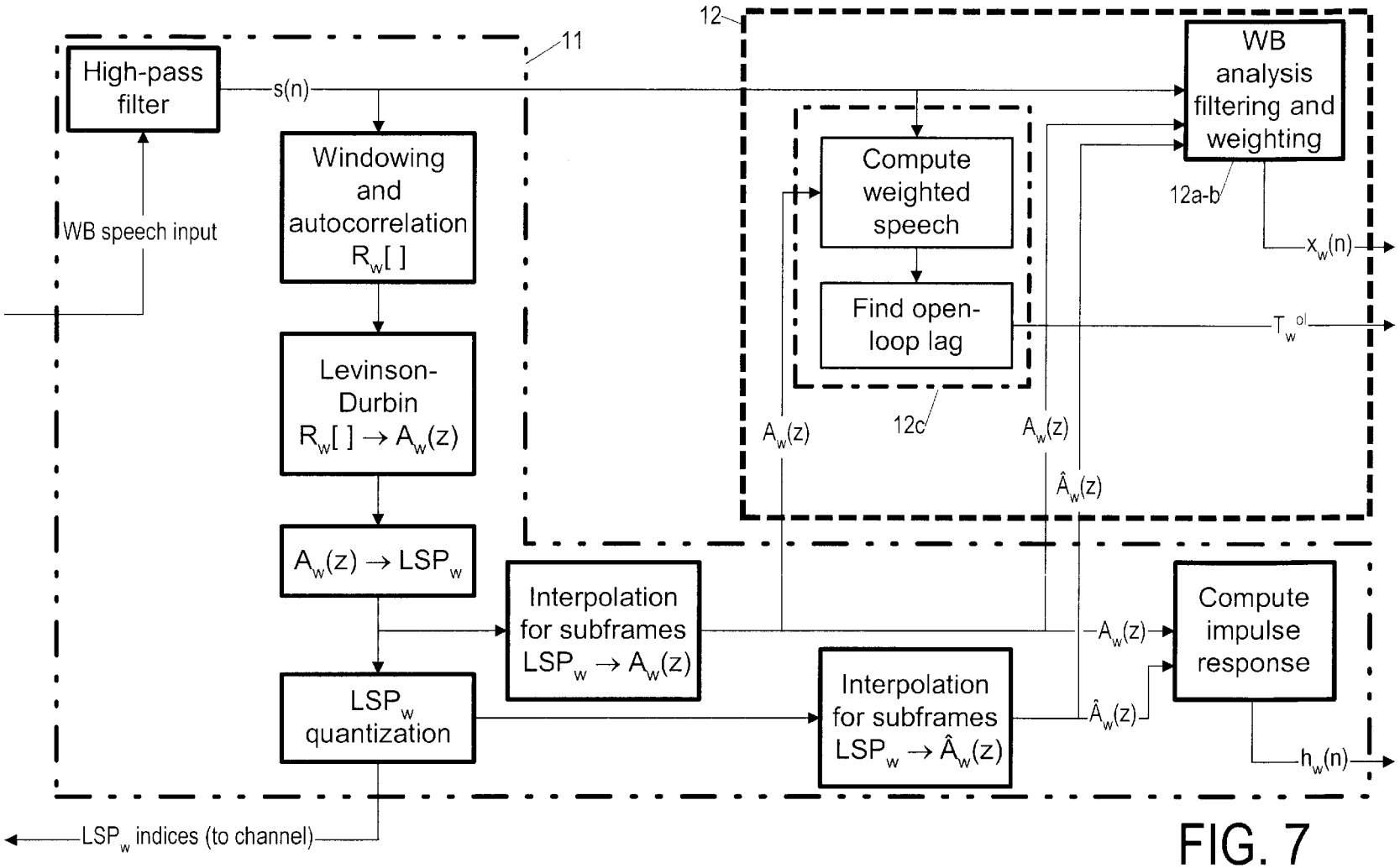
FIG. 7. Block diagram for a particular embodiment of LP analysis (indicated by blocks 11–12 in FIG. 1B) according to the invention.

Referring now to FIG. 1B, a wideband speech encoder 110, according to the present invention, is shown as including various modules for performing different processes, beginning with a wideband (WB) linear predictive (LP) analysis module 11 that determines a WB LP filter (i.e. the parameters of a filter for a wideband speech signal). Next, a WB LP analysis filter 12*a* and a module 12*b* for weighting of the WB signal are provided for determining a wideband target signal $x_w(n)$. These blocks act collectively to provide a wideband target signal $x_w(n)$. The variables in FIG. 1B, and in all the other figures except for FIG. 1A, use a subscript 'w' to indicate wideband; no subscript indicates the lower band frequency domain. (See FIG. 7 for a particular embodiment of the modules 11, 12*a*, and 12*b* in the context of an adaptive code excited linear predictive (ACELP) codec. Also indicated in FIG. 7 is a module for finding open loop lag, producing an output $T_w^{ol}$ Open loop lag is associated with a pitch period, or a multiple or sub-multiple of a pitch period. The present invention does not concern open loop lag.)

Figure 8:
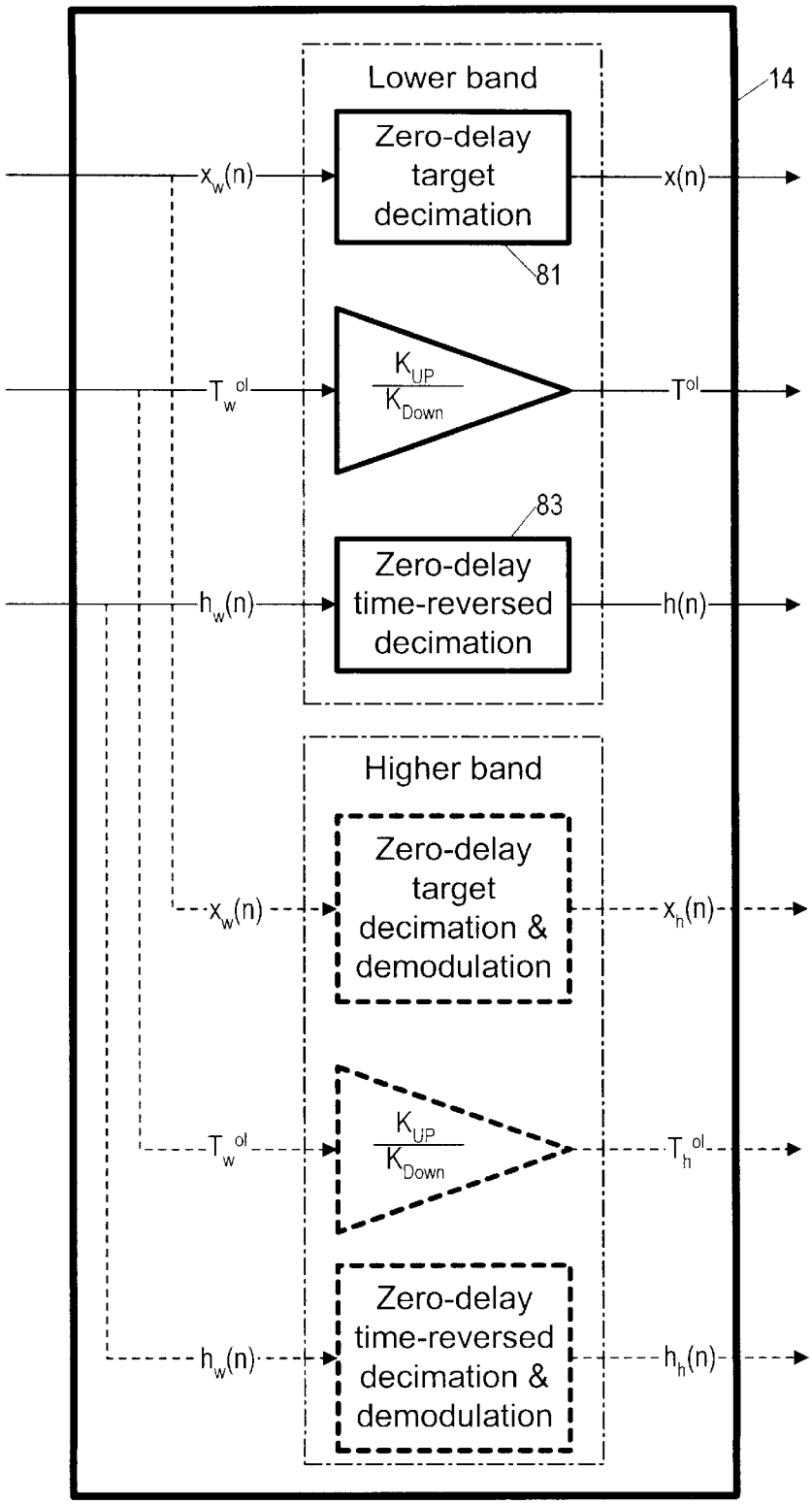
FIG. 8. Block diagram of band splitting (block 14 in FIG. 1B) according to the invention.
Figure 9:
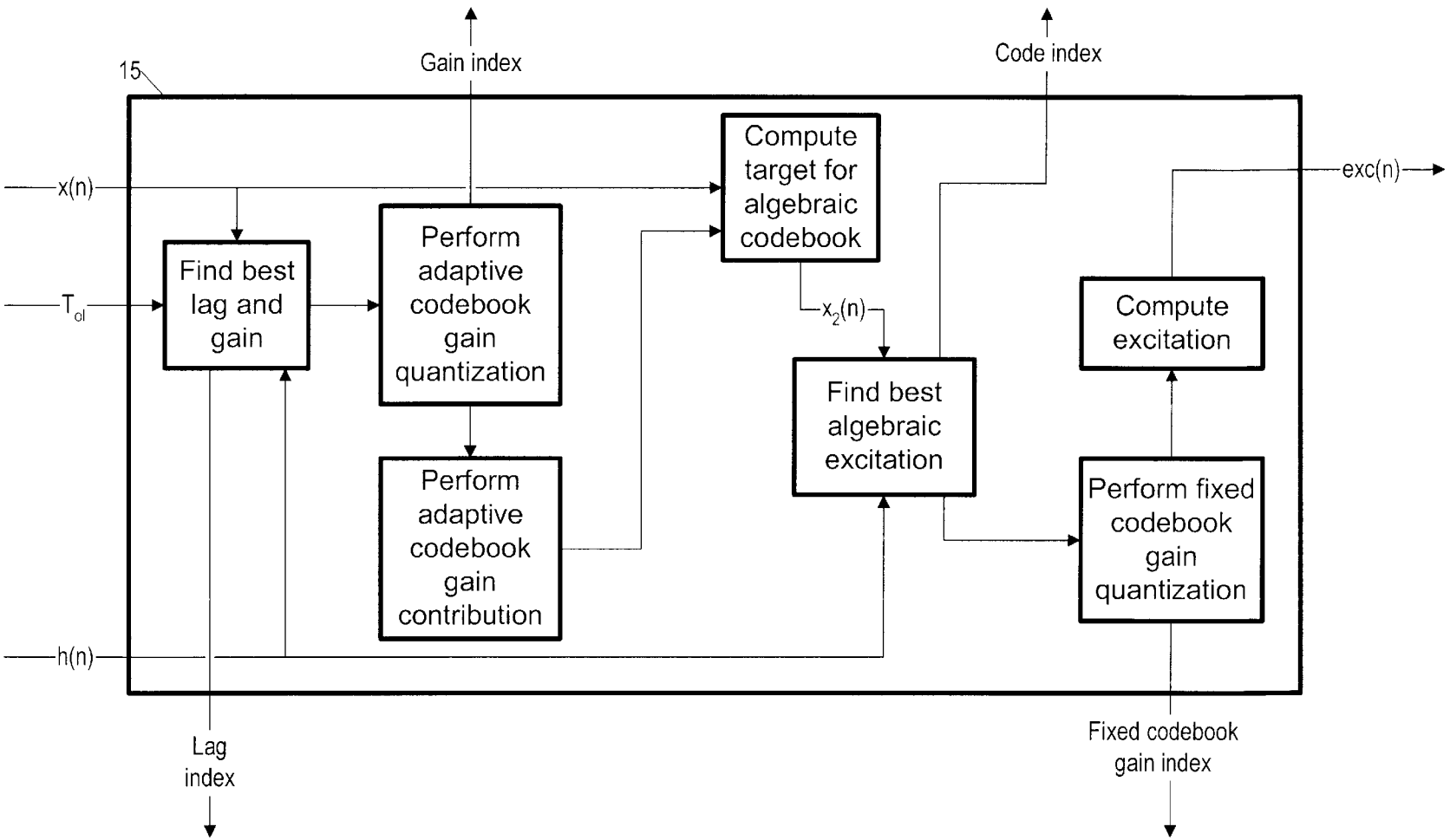
FIG. 9. Block diagram of a particular embodiment of Analysis-by-Synthesis in lower band (indicated by block 15 in FIG. 1B) according to the invention.

Thus, as a result of the processing of the WB speech input and preprocessing blocks 11 12, a wideband target signal $x_w(n)$ is obtained from the WB speech input. Next, the target signal is divided by a band-splitting module 14 into two bands, a lower band (LP) and a higher band (HB). (FIG. 8 shows the band-splitting module 14 in more detail.) The lower band signal x(n) is found by the band-splitting module 14 by decimating the wideband signal $x_w(n)$. The lower band signal x(n) is then provided to a lower band Analysis-by-Synthesis (LB A-b-S) module 16, which uses the impulse response h(n) (for the lower band) of the corresponding LP synthesis filter in a search (of codebooks) for an optimum lower band excitation signal exc(n). The impulse response h(n) is obtained by the band-splitting module 14 by decimating the impulse response $h_w(n)$ of the wideband LP synthesis filter. (FIG. 9 shows the LB A-b-S module 16 in more detail.)

In the processing by the band-splitting module 14 to obtain the higher band signal, the wideband signal is high-pass filtered, and the higher frequencies $[0.5F_s^{lower}, 0.5F_s^{wide})$ are downshifted to $[0, 0.5F_s^{wide}-0.5F_s^{lower})$, i.e. the higher band is modulated. The higher band is then processed by the band-splitting module 14 in the same way as the lower band, providing a higher band signal $x_h(n)$ and a higher band impulse response $h_h(n)$. A higher band Analysis-by-Synthesis (HB A-b-S) module 15 then provides a higher band excitation signal $exc_h(n)$ using the higher band signal $x_h(n)$ and the higher band impulse response $h_h(n)$.

In an alternative embodiment, to further decrease the coding complexity and the source coding bit rate, the HB A-b-S module 15 is by-passed. However, unlike in the sub-band coding of the prior art, in the present invention LP analysis is performed on the (full) wideband speech signal, i.e. the LP filter models the entire wideband spectrum. For the alternative embodiment in which the HB A-b-S module 15 is by-passed, the modules in FIGS. 1, 8 and 10 drawn with dashed lines are to be ignored. In this alternative embodiment, a band-combining module 17, to be discussed below, only interpolates the lower band excitation exc(n). The higher band excitation $exc_h(n)$ is identically zero, and there is therefore no actual band-combining by the band-combining module 17 in this embodiment.

Figure 10:
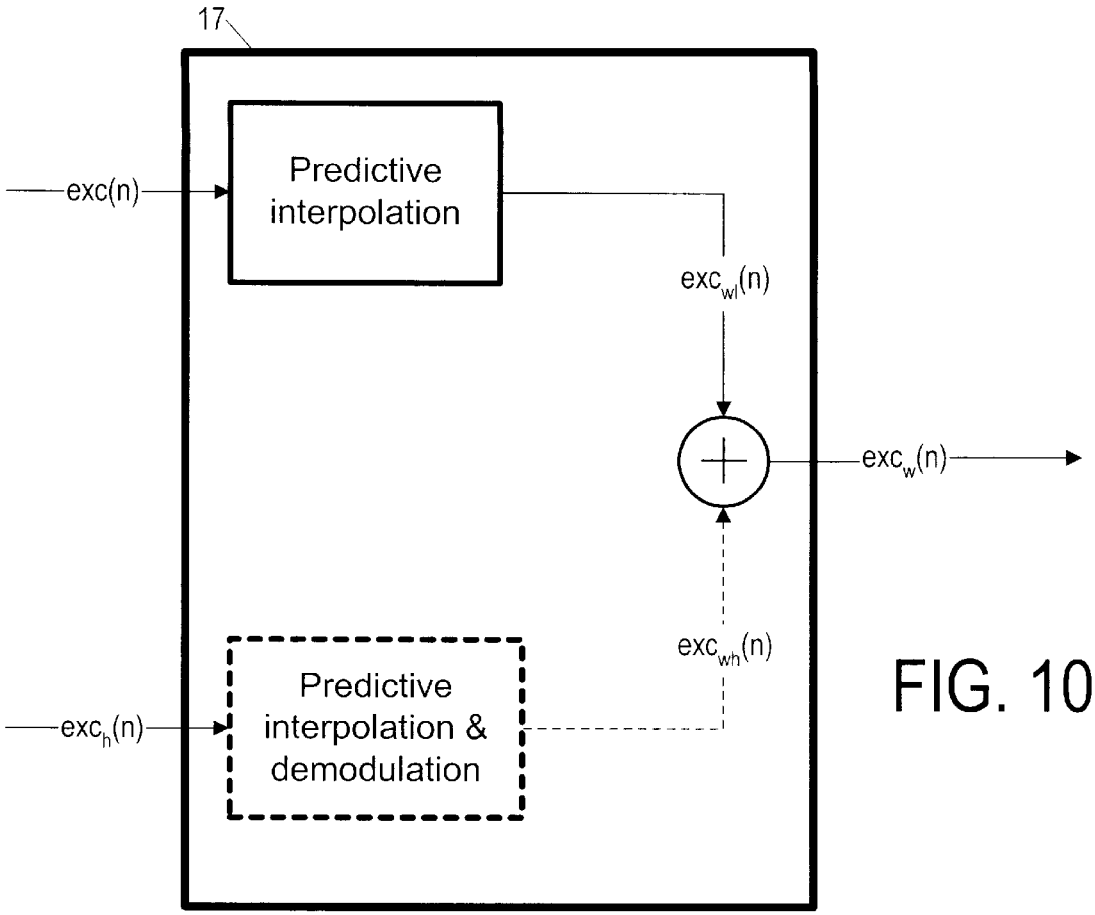
FIG. 10. Block diagram of band combination (indicated by block 17 in FIG. 1B) according to the invention.

Next, a band-combining module 17 constructs the wideband excitation $exc_w(n)$ using the lower and higher band excitations exc(n) and $exc_h(n)$. To do this, the band-combining module 17 first interpolates the lower band excitation exc(n) to the wideband sampling rate. In the embodiment where the higher band excitation is not searched, its contribution is ignored. In yet another embodiment, the higher band excitation $exc_h(n)$ is generated without analysis by using a pseudo-noise or a white noise type of excitation in order to synchronize encoder and decoder. (FIG. 10 shows the band-combining module 17 in more detail.)

Figure 11:
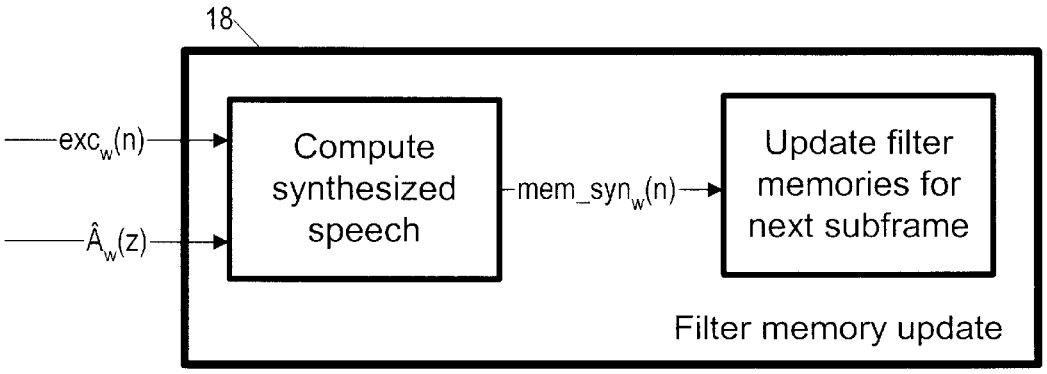
FIG. 11. Block diagram of a particular embodiment of LP synthesis (block 18 in FIG. 1B) in the encoder, according to the invention.

Finally, the wideband excitation $exc_w(n)$ is passed through a wideband LP synthesis filter 18 to update the zero-input memory for a next subframe of the WB speech input. (See FIG. 11 for a more detailed illustration of the modules used for the WB LP synthesis.) Note that the synthesis filter 1/A(z) in the embodiment of a codec shown in FIG. 1A can be expressed as:

$$\frac{1}{\hat{A}(z)} = 1/[1 + a_1 z^{-1} + a_2 z^{-2} + a_3 z^{-3} + \ldots + a_{10} z^{-10}]$$

which differs in the denominator on the right hand side from the expression for the synthesis filter for the embodiment of FIG. 1A.

Figure 2:
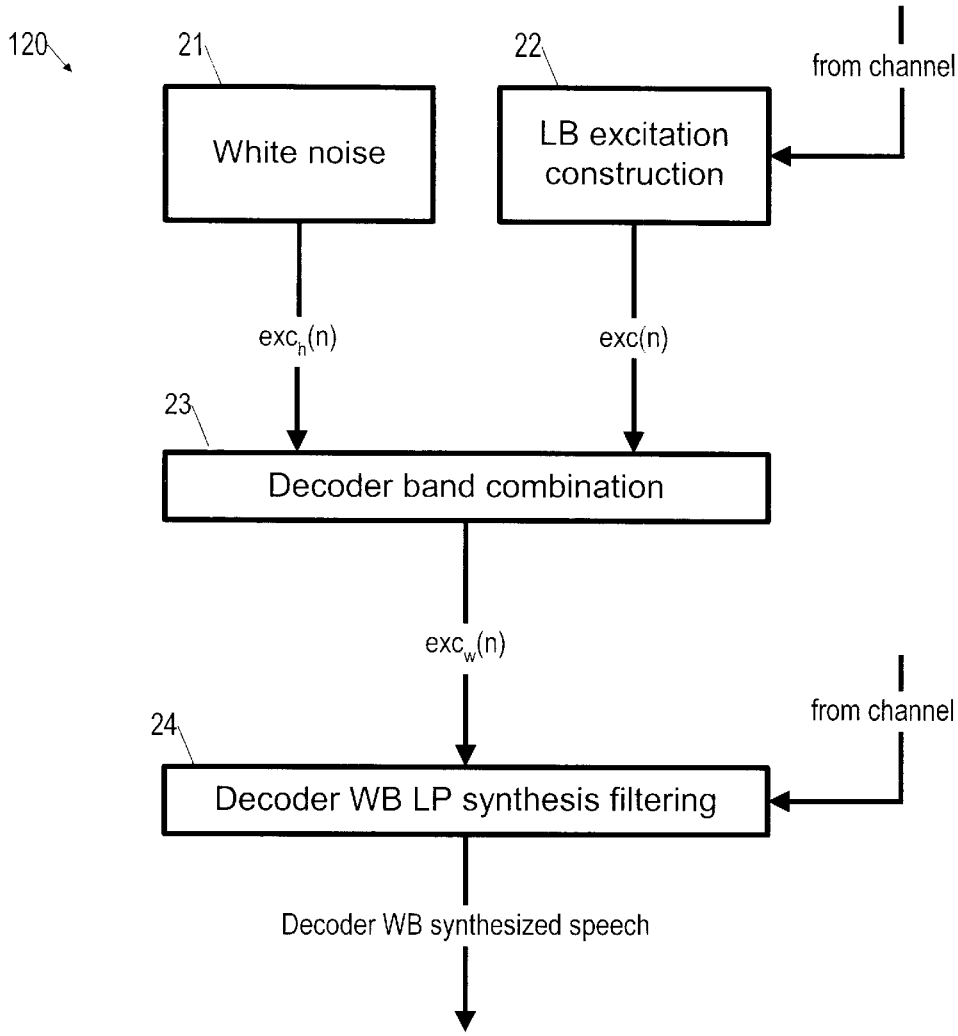
FIG. 2 is a simplified block diagram of the CELP speech decoder according to the invention.
Figure 12:
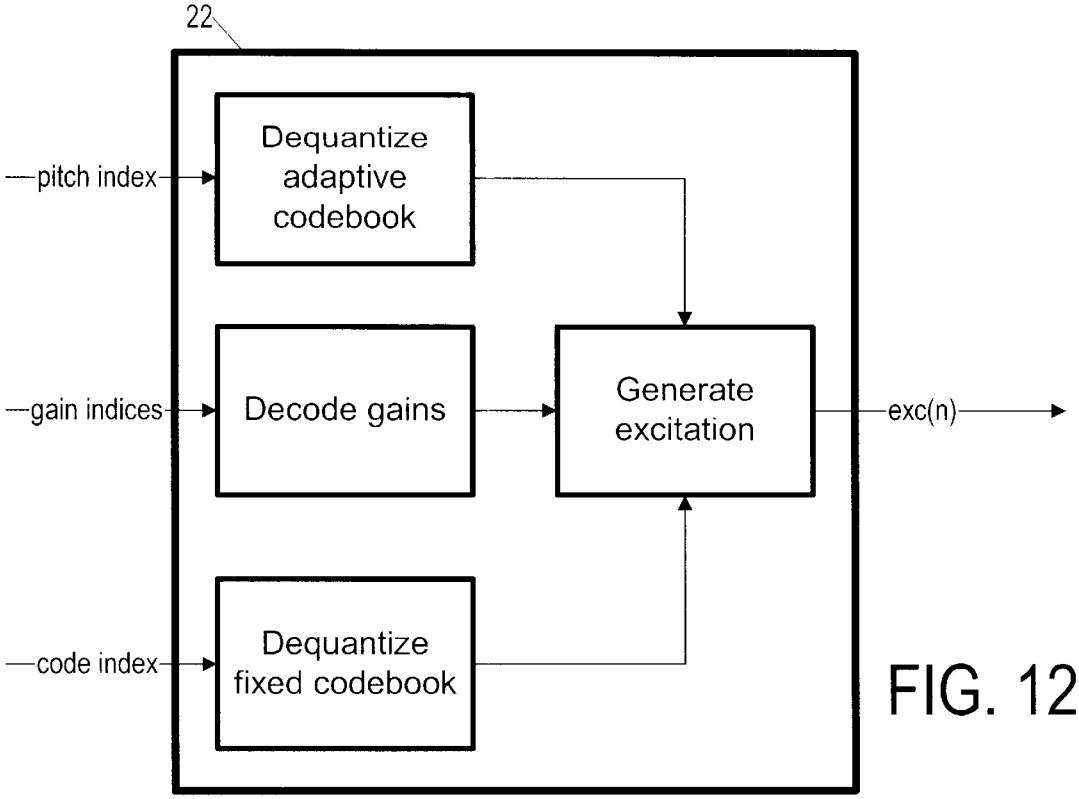
FIG. 12. Block diagram of a particular embodiment of LB excitation construction (block 22 in FIG. 2) in the decoder, according to the invention.

Referring now to FIG. 2, a decoder 120 according to the present invention is shown in an embodiment in which a white noise source 21 generates excitation for the higher band. An LB excitation construction module 22 constructs the lower band excitation exc(n) using the outputs provided by the encoder (FIG. 1B), namely the output of the LB A-b-S module 16 (parameters describing the excitation exc(n) including a power level for the excitation) and the output of the WB LP analysis module 11 (the inverse filter $\tilde{A}_w(z)$ or equivalent information). (The LB excitation construction module 22 is shown in more detail in FIG. 12.)

Figure 13:
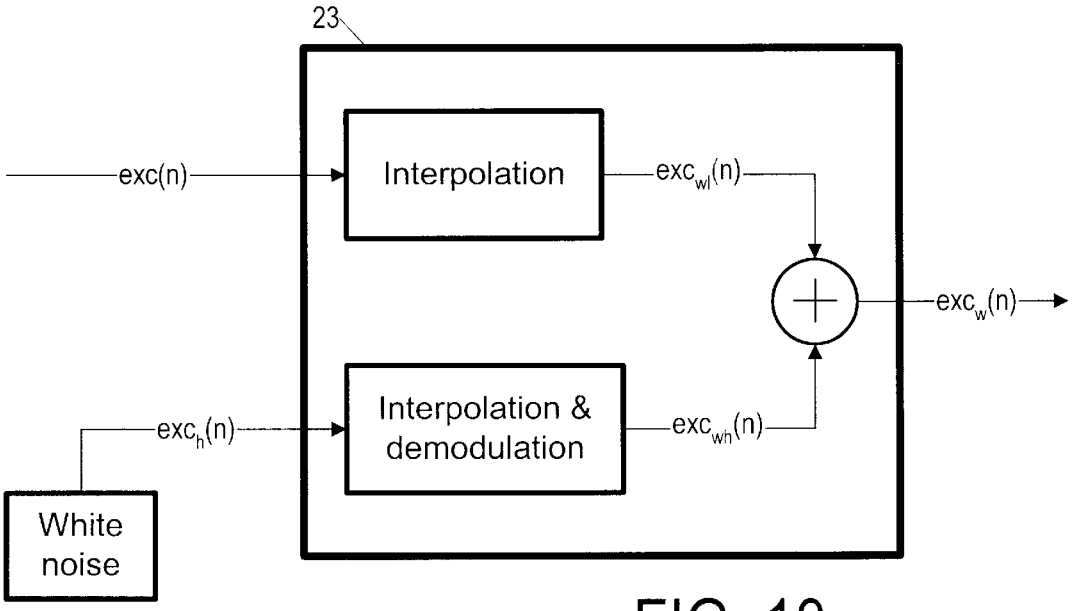
FIG. 13. Block diagram of band combination (block 23 in FIG. 2) in the decoder, according to the invention.
Figure 14:
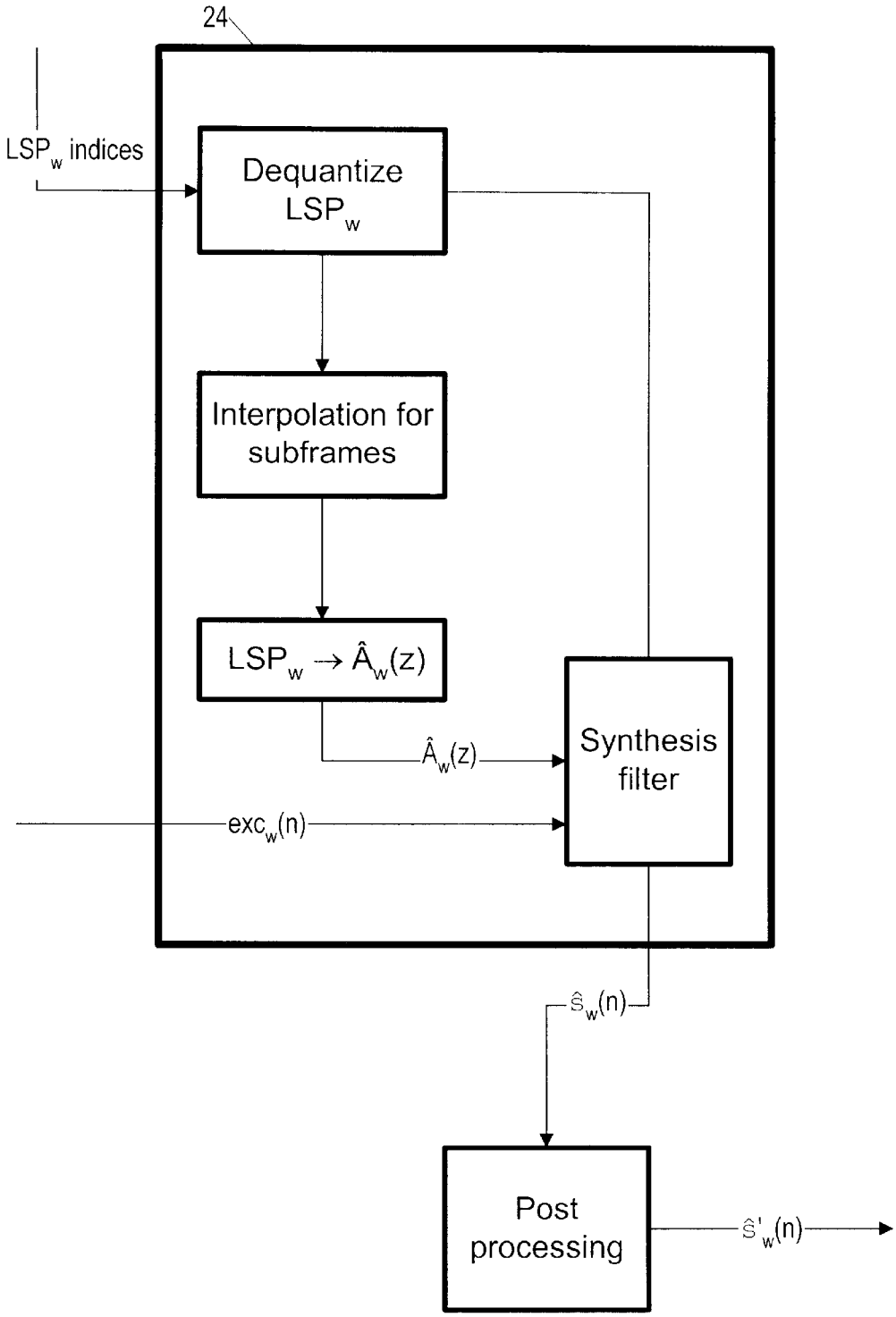
FIG. 14. Block diagram of a particular embodiment of synthesis filtering (block 24 in FIG. 2) in the decoder, according to the invention.

Next, a decoder band-combining module 23 creates a wideband excitation $exc_w(n)$ from a higher band excitation $exc_h(n)$ provided by the white noise source 21 and the lower band excitation exc(n). (FIG. 13 shows the decoder band-combining module 23 in more detail in the embodiment where white noise is used in the decoder.) Finally, a decoder WB LP synthesis filter 24 produces a decoder WB synthesized speech using the decoder wideband excitation $exc_w(n)$ and the WB LP synthesis filter received from the encoder, i.e. $\tilde{A}_w(z)$ or equivalent information. (FIG. 14 shows an implementation of the decoder WB LP synthesis filter 24.) The band-combining module 17 and WB LP synthesis filtering module 18 of the encoder (FIG. 1B) perform the same functions as the corresponding modules 23 24 (FIG. 2) of the decoder.

With the invented coding method, the whole amplitude spectrum envelope of the wideband speech signal can be reconstructed correctly using less bits than in the prior-art solution performing LP analysis for the lower and higher band separately. This is because the poles of the LP filter can be concentrated anywhere in the full frequency band, as needed.

Compared to full-band coding, the coding complexity of the present invention is significantly less, because coding complexity builds up mostly from the search (of the fixed and adaptive codebooks) for the excitation, and in the present invention, the search for the excitation is performed using only the lower band signal.

A complication of the approach of the present invention is that there is a delay introduced by the decimation and the interpolation filter used in processing the lower band signals. The delay changes the time alignment of the excitation search with respect to the LP analysis, and must be compensated for.

Decimation Delay in Impulse Response

The fixed codebook search performed by the LB A-b-S module 16 needs the impulse response h(n) of the LP synthesis filter 18. The LP synthesis filter 18, characterized by $1/\tilde{A}_w(z)$, is the inverse of the LP analysis filter provided by the LP analysis search module 11, i.e. the filter characterized by $\tilde{A}_w(z)$. Thus, the LP analysis search module 11 determines both the LP analysis filter $\tilde{A}_w(z)$ as well as the LP synthesis filter $1/\tilde{A}_w(z)$.

Because the fixed codebook search is performed for the lower band signal x(n), the impulse response h(n) of the lower band LP synthesis filter is needed in the LB A-b-S module 16. The impulse response h(n) of the synthesis filter should have the same filtering characteristics as the lower part of the amplitude response of the wideband LP synthesis filter $1/\tilde{A}_w(z)$. Such filtering characteristics can be obtained by decimating the impulse response $h_w(n)$ of the wideband LP synthesis filter 18.

Figure 3:
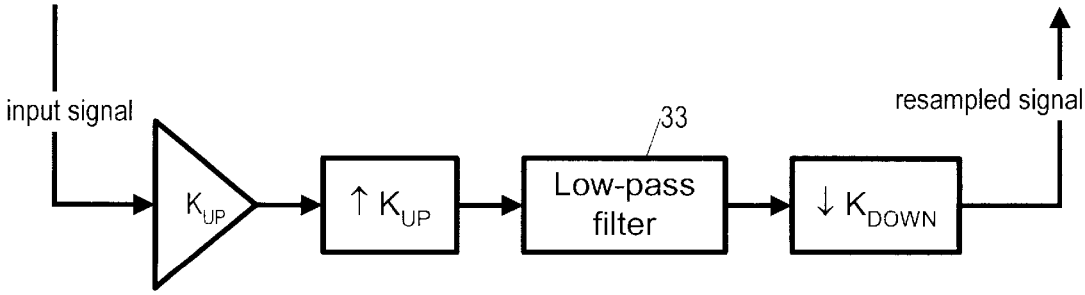
FIG. 3. is a block diagram of a resampling process, which can be either interpolation or decimation.
Figure 4:
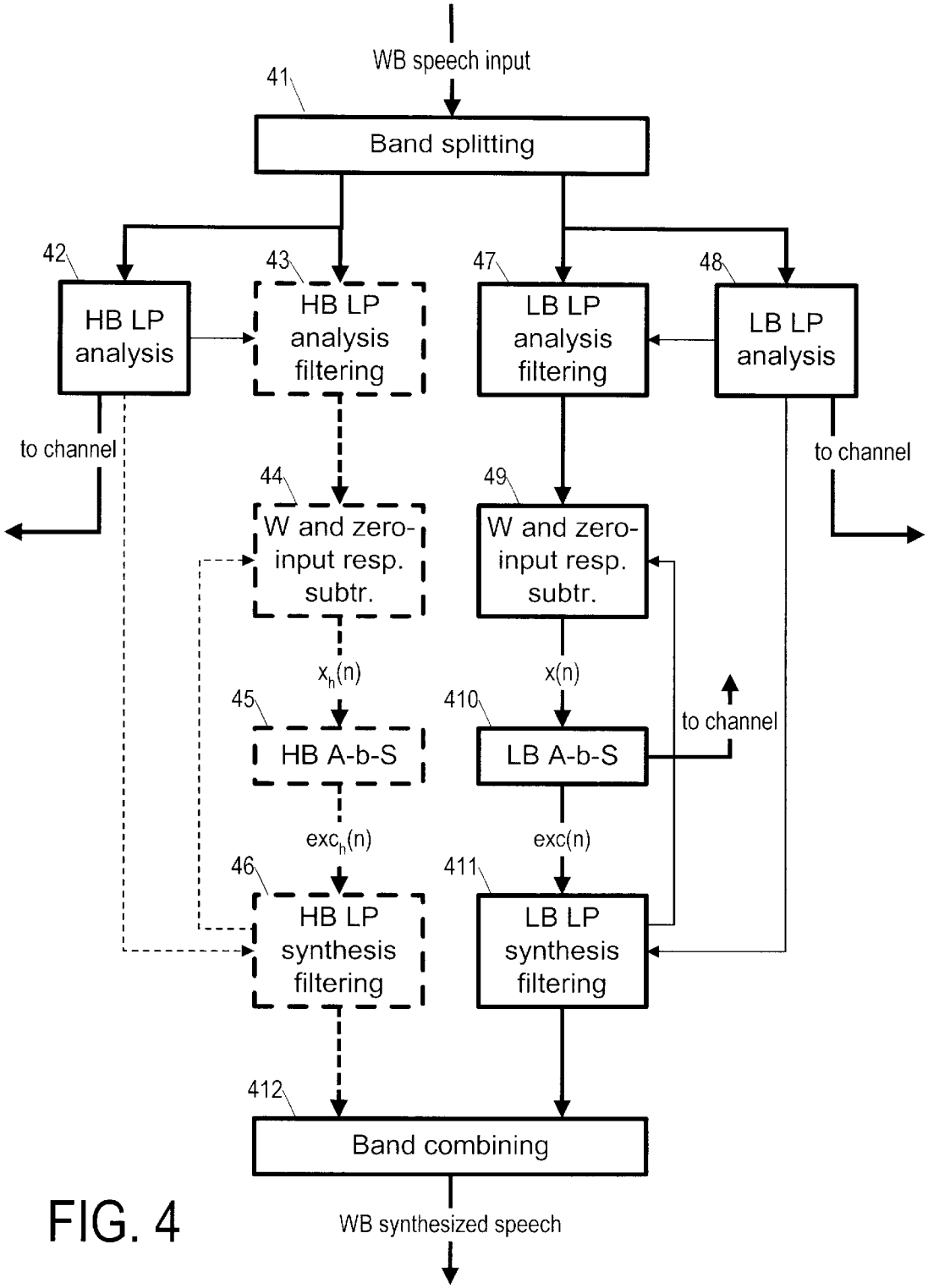
FIG. 4. Simplified block diagram of the CELP speech encoder according to a prior-art solution.
Figure 5:
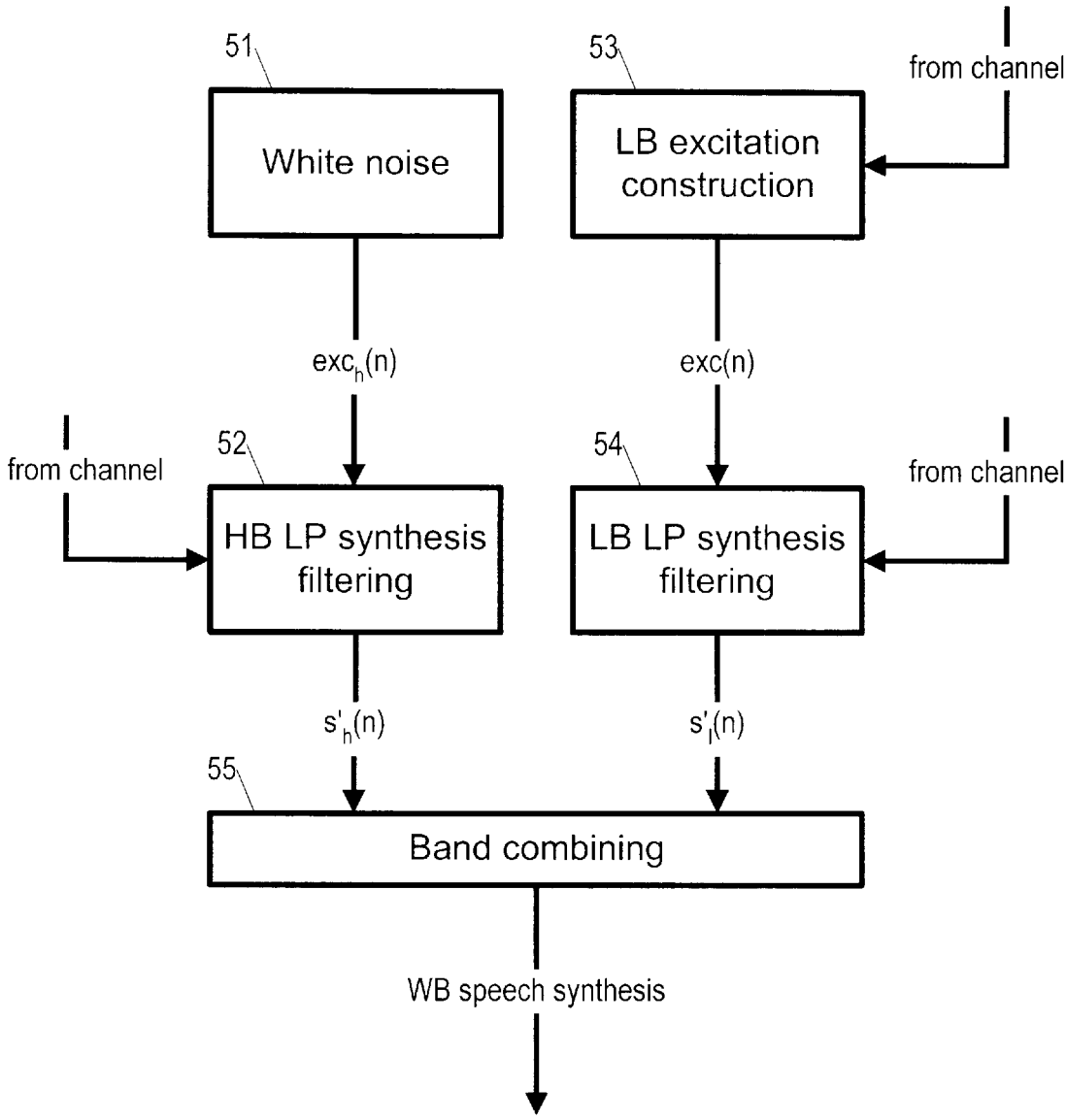
FIG. 5. Simplified block diagram of the CELP speech decoder according to a prior-art solution.

Referring now to FIG. 3 and interpreting it as an illustration of a decimating resampling process (it is also used below to illustrate an interpolating resampling process), the decimating of an input signal is shown to produce a resampled signal having a data rate that is less than the data rate of the input signal. The input signal is decimated by the factor $K_{UP}/K_{DOWN}$ (which for decimating is less than unity because for decimating $K_{UP}$ is made to be less than $K_{DOWN}$), where $K_{UP}=F_s^{wide}/\gcd(F_s^{wide}, F_s^{narrow})$ represents a factor for up-sampling, and $K_{DOWN}=F_s^{narrow}/\gcd(F_s^{wide}/F_s^{narrow})$ represents a factor for down-sampling (where in each expression gcd indicates the function "greatest common divisor"). (For the interpolating process described below, $K_{DOWN}$ is less than $K_{UP}$.)

Still referring to FIG. 3, the decimating process uses a (low-pass) decimation filter 33, which introduces a delay $D_{low\text{-}pass}$ of the lower band processing relative to the zero-input response subtraction module 12*b*, causing a problem in subtracting the zero-input response from the correct position of the input speech. In the present invention, the decimation delay problem is solved by low-pass filtering the impulse response $h_w(n)$ of the WB LP synthesis filter from the end to the beginning of the response, and by designing the (low-pass) decimation filter 33 so that its delay, expressed as $D_{low\text{-}pass}$ samples, is less than or equal to $K_{DOWN}$ samples. ($K_{DOWN}$ is a dimensionless constant used to indicate a factor by which a sampling rate is reduced; thus, e.g. a sampling rate R is said to be down-sampled by $K_{DOWN}$ to a new, lower sampling rate, $R/K_{DOWN}$.) When the delay of the decimation filter is less than or equal to $K_{DOWN}$ samples, the delay of the lower-band processing relative to the zero-input response subtraction module 12*b* is less than or equal to one sample.

With such a procedure the last sample is the only one missing after the decimation filtering. Because the impulse response is filtered from its end to its beginning, the missing sample is the first sample of the impulse response, which is always 1.0 in an LP filter. Thus, the decimated impulse response is known in its entirety.

Referring now to FIG. 8, the decimation of the impulse response $h_w(n)$ is provided by a zero-delay time-reversed decimation module 83, so named because there is a compensating for the delay $D_{low\text{-}pass}$ by shifting the filtered signal $D_{low\text{-}pass}$ steps forward (i.e. so as to get to zero-delay), and by inserting 1.0 for the missing last element (as explained above), and because the filtering is performed from the end to the beginning of the impulse response $h_w(n)$, i.e. in time-reversed order.

Interpolation Delay in Synthesized Speech

There is also a delay introduced by the low-pass filtering in the band-combining module 24 in the decoder 120 and in the band-combining module 17 in the encoder 110 (FIGS. 1B and 2), a delay caused by interpolation. Because of the interpolation performed there, the WB synthesized speech signal is delayed with respect to the frame being analyzed. In the analysis of the next subframe, the state of the LP synthesis filter at the end of the current analyzed subframe must be known, but only the state for the synthesized frame is known. In the present invention, to address the interpolation delay problem, the LP synthesis filtering is continued on to the end of the current synthesized subframe so as to look ahead (in time) to determine the state for the next analyzed subframe.

Figure 6:
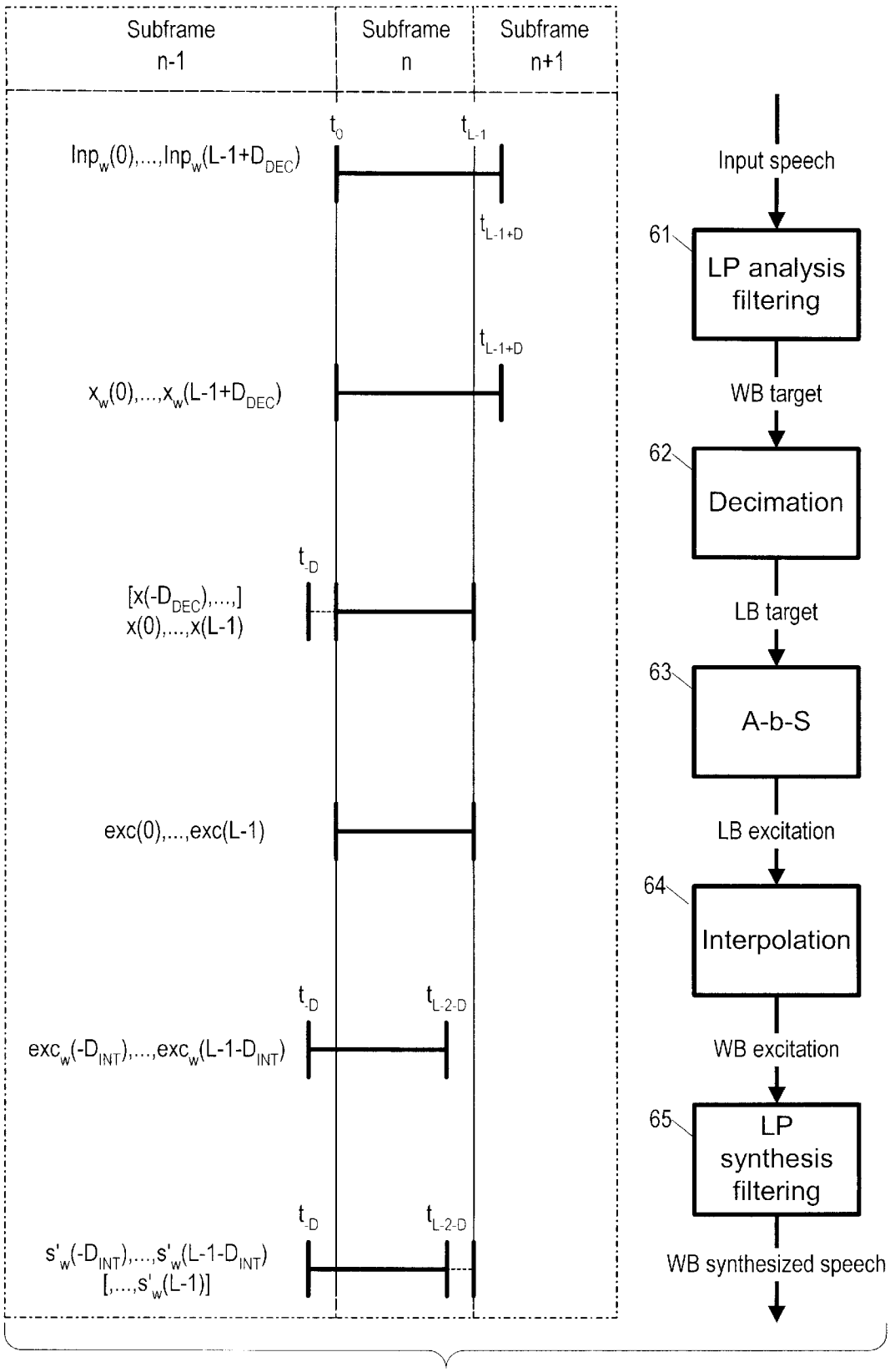
FIG. 6. Delay budget for the invention.

Referring now to FIG. 6, the handling by the present invention of the decimation delay (caused by the decimating performed by the band-splitting module 14 of FIG. 1) and the interpolation delay (caused by the interpolating by the band-combining module 17 of FIG. 1) is shown. An LP analysis filtering module 61 and a decimation module 62 (part of the band-splitting module 14 of FIG. 1) each execute for a length of time (measured in subframes) of $L_{SUBFR}+D_{DEC}$, where $L_{SUBFR}$ is the length of the subframe and $D_{DEC}$ is the delay introduced by the decimation module 62.

Referring again to FIG. 8, the decimation of the target signal is performed by a zero-delay target decimation module 81, so named because there is a compensating for any delay so as to always achieve zero delay. The compensating is performed by filtering the input signal until the end of the subframe has appeared in the output of the filter, i.e. by increasing the length of the filtering by $D_{DEC}$. Thus in the LP analysis filtering 12*a* in the encoder 110, the last $D_{DEC}$ samples must be filtered through the LP analysis filter of the next subframe or its estimate. Because of the delay, the first $D_{DEC}$ samples of the output of the decimation ($x[-D_{DEC}], \ldots, x[-1]$) are from the previous subframe. Therefore, these first $D_{DEC}$ samples are ignored in extracting the lower band target signal for the excitation. (only the encoder needs to compensate for the delay of the band-combining with additional filtering, because the LP analysis filtering 12*a* is performed only in the encoder 110. The LP analysis filter of the next subframe is available and so can be used except in case of the last subframe, because the next subframe after the last subframe in a frame belongs to the next frame, and is not available; it must therefore be estimated.)

Referring again to FIG. 6, next the lower band excitation is interpolated (in the band-combining module 17 of FIG. 1) in an interpolation module 64 to obtain a wideband excitation $exc_w(n)$. The interpolation module 64 introduces a delay into the wideband excitation $exc_w(n)$ used by a wideband LP synthesis filtering module 65. Therefore, the wideband LP synthesis filtering module 65 has to start with the previous subframe. After filtering $D_{INT}$ samples, where $D_{INT}$ is the delay of the interpolation, the wideband LP synthesis filter 65 used in the current subframe has to be employed because the first $D_{DEC}$ samples of the output of the interpolation $(L_{EXC}[-D_{INT}], \ldots, L_{EXCl}-1])$ are from the previous subframe.

After the synthesized speech signal has been determined, the synthesis filtering has to be continued until the end of the analyzed subframe to get the zero-input response. This is problematic because there is no more excitation to be used as input for the filter, and thus filtering cannot be continued. However, if the delay $D_{INT}$ of the interpolation is one sample long, the missing last sample can be set to be the last sample of the lower band excitation.

Referring again to FIG. 3, but this time interpreting it to illustrate an interpolating resampling process, so that $K_{DOWN}$ is less than $K_{UP}$, the sampled signal is effectively resampled at a rate that is the product of the factor $K_{Up}/K_{DOWN}$ (>1) and the original sampling rate. By designing the low-pass filter of the interpolation in such a way that its delay is $K_{DOWN}$ samples long, the delay of the interpolation becomes one sample long, the wideband excitation can be constructed up to the end, and the zero-input response can be generated. (In FIG. 10, interpolation is also shown, but the interpolation there is predictive interpolation of the excitation, so-called because the delay of the basic interpolation, as indicated in FIG. 3, is compensated for by inserting for the missing last element what it would always be, i.e. the last element of the output is predicted.)

Referring again to FIG. 1B, in one embodiment of the present invention, the LB A-b-S module 16 of the encoder 110 is flexibly switchable, without producing any significant artifacts, from wideband A-b-S to narrowband A-b-S excitation searching (with corresponding inputs and outputs), by replacing the decimation and interpolation in the band-splitting module 14 and band-combining module 17 respectively with delay blocks that delay the signal but do not change it in any other way. So if a codec has both a full-band mode and also a quasi-sub-band mode according to the present invention (quasi-sub-band mode intending to indicate that there is first LP analysis of the entire wideband signal, and only then is there band-splitting), in this embodiment switching between modes is possible and does not introduce any artifacts.

Thus, in the present invention, in general, a coder consists of wideband LP analysis and synthesis parts and a lower band excitation search part. The excitation is determined using the output of the wideband LP analysis filtering, and the lower band excitation thus obtained is used by the wideband LP synthesis filtering. The excitation search part can have a sampling rate that is lower or equal to the wideband part. It is possible and often advantageous to change the sampling rate of the excitation adaptively during the operation of the speech codec in order to control the trade-off between complexity and quality.

The present invention is obviously advantageously applied in a mobile terminal (cellular telephone or personal communication system) used with a telecommunications system. It is also advantageously applied in a telecommunications network including mobile terminals or in any other kinds of telecommuncations network as well. In a telecommunications network including an interface to mobile terminals (by a radio interface), a coder based on the invention can be located in one type of network element and a corresponding decoder in another type of network element or the same type of network element. For example, the entire codec functionality, based on a codec according to the present invention, could be located in a transcoding and rate adaptation unit (TRAU) element. The TRAU element is usually located in either a radio network controller/base station controller (RNC), in a mobile switching center (MSC), or in a base station. It is also sometimes advantageous to locate a speech codec according to the present invention not in a radio access network (including base stations and an MSC) but in a core network (having elements connecting the radio access network to fixed terminals, exclusive of elements in any radio access network).

Scope of the Invention

It is to be understood that the above-described arrangements are only illustrative of the application of the principles of the present invention. Numerous modifications and alternative arrangements may be devised by those skilled in the art without departing from the spirit and scope of the present invention, and the appended claims are intended to cover such modifications and arrangements.

What is claimed is:

1. A system for encoding an $n^{th}$ frame in a succession of frames of a wideband (WB) speech signal, the system comprising:

a) a WB linear predictive (LP) analysis module (11) responsive to the $n^{th}$ frame of the wideband speech signal, for providing LP analysis filter characteristics;

b) a WB LP analysis filter (12*a*), also responsive to the $n^{th}$ frame of the WB speech signal, for providing a filtered WB speech input;

c) a band-splitting module (14), responsive to a WB target signal $x_w(n)$ determined from the filtered WB speech input for the $n^{th}$ frame, for splitting the filtered WB target signal $x_w(n)$ into a plurality of bands, the band-splitting module for providing a lower band (LB) target signal x(n);

d) an excitation search module (16), responsive to the LB target signal x(n), for providing an LB excitation exc (n); and e) a band-combining module (17), responsive to the LB excitation exc(n) and optionally to an additional signal serving as a higher band (HB) excitation $exc_h(n)$, for interpolating the LB excitation exc(n) to provide an interpolated LB excitation, and for optionally combining the interpolated excitation and the additional signal so as to provide a WB excitation $exc_w(n)$.

2. A system as claimed in claim 1, wherein the band-splitting module (14) further provides a higher-band (HB) target signal $X_h(n)$, and wherein the system further comprises:

a) an excitation search module (15), responsive to the HB target signal $x_h(n)$, for providing an HB excitation $exc_h(n)$;

and further wherein the band-combining module (17) is further responsive to the HB excitation $exc_h(n)$.

3. A system as claimed in claim 1, wherein the band-splitting module (14) determines the LB target signal x(n) by decimating the WB target signal $x_w(n)$, and wherein the band-combining module (17) includes a module for interpolating the LB excitation exc(n) to provide the WB excitation $exc_w(n)$.

4. A system as claimed in claim 1, wherein in decimating the WB target signal $x_w(n)$, a decimating delay is introduced that is compensated for by filtering a WB impulse response hw(n) from the end to the beginning of the frame using a decimating low-pass filter that limits the delay of the decimating to one sample per frame, and wherein in interpolating the LB excitation exc(n), an interpolating delay is introduced that is compensated for by using an interpolating low-pass filter that limits the delay of the interpolating to one sample per frame.

5. A system as in claim 1, further comprising a decoder for decoding an $n^{th}$ encoded frame in a succession of encoded frames of a wideband (WB) speech signal, the encoded frames each providing information indicating a lower band (LB) excitation exc(n) and linear predictive (LP) analysis filter characteristics, the system comprising:

a) an LB excitation construction module (22), responsive to information indicating the LB excitation exc(n), for providing the LB excitation exc(n);

b) a decoder band-combining module (23), responsive to the LB excitation exc(n) and optionally to an additional signal serving as a higher band (HB) excitation $exc_h(n)$, for interpolating the LB excitation exc(n) to provide an interpolated LB excitation, and for optionally combining the interpolated excitation and the additional signal so as to provide a WB excitation $exc_w(n)$; and c) a decoder WB LP synthesis filter (24), responsive to the LP analysis filter characteristics and to the WB excitation $exc_w(n)$, for providing WB synthesized speech; wherein the LP analysis filter characteristics are determined based on the full wideband speech signal.

6. A system as claimed in claim 5, further comprising a white noise source (21) for providing a higher band (HB) excitation $exc_h(n)$, and wherein the decoder band-combining module (23) is further responsive to the HB excitation $exc_h(n)$.

7. A method for use by a codec in encoding a wideband (WB) speech signal, comprising the steps of:

a) performing (11) a WB linear predictive (LP) analysis, responsive to the WB speech signal, for providing LP filter characteristics;

b) performing (12) WB LP filtering of the WB speech signal at a WB sampling rate, responsive to the WB speech signal and to the LP filer characteristics, for providing a WB target signal $x_w(n)$;

c) performing (14) a band-splitting of the WB target signal $x_w(n)$ so as to provide a lower band (LB) target signal x(n), responsive to the WB target signal $x_w(n)$, the LB target signal x(n) containing information about error in reproducing components of the speech signal at frequencies contained in a lower frequency band compared to at least one higher frequency band in a plurality of frequency bands spanned by the WB speech signal; and d) performing (16) an excitation search for a LB excitation exc(n) representing the LB target signal x(n), the excitation search for a LB excitation exc(n) including sampling at a LB sampling rate; wherein the LB sampling rate is less than the WB sampling rate; and also e) performing (17) a band-combining step, responsive to the LB excitation exc(n) and optionally to an additional signal serving as a higher band (HB) excitation $exc_h(n)$, for interpolating the LB excitation exc(n) to provide an interpolated LB excitation, and for optionally combining the interpolated excitation and the additional signal so as to provide a WB excitation $exc_w(n)$.

8. A method according to claim 7, wherein any delay that results from the sampling rate difference between the WB sampling rate used in the LP filtering and the LB sampling rate used in the search for an LB excitation exc(n) is compensated for by extending the duration of the LP analysis filtering.

9. A method according to claim 7, wherein any delay that results from the sampling rate difference between the WB sampling rate used in the LP filtering and the LB sampling rate used in the excitation search for an LB excitation exc(n) is compensated for by causing the interpolation of the LB excitation signal exc(n) to have a delay of one sample, and by copying the last sample of the LB excitation exc(n) to the last sample of the WB excitation $exc_w(n)$.

10. A method according to claim 7, wherein a WB impulse response $h_w(n)$ is used in the wideband LP synthesis filtering and is decimated in the step of performing a band-splitting in such a way that the delay of the decimation is less than or equal to one sample, and that the decimation filtering in the band-splitting step is performed from the end to the beginning of the impulse response $h_w(n)$.

11. A method according to claim 7, wherein the LB excitation exc(n) is determined by a search using analysis-by-synthesis.

12. A method as in claim 7, further comprising the steps of:

a) performing (17 23) a band-combining step, responsive to the LB excitation exc(n), the band-combining step including an interpolation of the LB excitation exc(n), for providing a WB excitation $exc_w(n)$.

13. A method as in claim 7, wherein in the band-combining step, either white noise or a null signal is used as an excitation for speech information at frequencies above the frequencies represented by the LB excitation.

14. A system for encoding an $n^{th}$ frame in a succession of frames of a wideband (WB) speech signal, the system comprising:

a) a WB linear predictive (LP) analysis module (11), responsive to the $n^{th}$ frame of the WB speech signal, for providing LP analysis filter characteristics;

b) a WB LP analysis filter (12*a*), also responsive to the $n^{th}$ frame of the WB speech signal, for providing a filtered WB speech input;

c) a decimation module (14), responsive to a WB target signal $x_w(n)$ determined from the filtered WB speech input for the $n^{th}$ frame, for decimating the filtered WB speech input, to provide a lower band (LB) target signal x(n);

d) an excitation search module (16), responsive to the LB target signal x(n), for providing a LB excitation exc(n);

e) an interpolation module (17), responsive to the LB excitation exc(n) and optionally to an additional signal serving as a higher band (HB) excitation $exc_h(n)$, for interpolating the LB excitation signal exc(n) to provide an interpolated LB excitation, and for optionally combining the interpolated excitation and the additional signal so as to provide a WB excitation $exc_w(n)$; and f) a WB LP synthesis filter (18), responsive to the LP analysis filter characteristics and to the WB excitation $exc_w(n)$, for providing WB synthesised speech.

15. A system for encoding an $n^{th}$ frame in a succession of frames of a wideband (WB) speech signal, the system comprising:

a) a WB linear predictive (LP) analysis module (11), responsive to the $n^{th}$ frame of the WB speech signal, for providing LP analysis filter characteristics, further for providing an LP analysis filter impulse response $h_w(n)$ for the $n^{th}$ frame, further for providing a quantified inverse filter characterization $\tilde{A}_w(z)$;

b) a WB LP analysis filter (12*a*), also responsive to the $n^{th}$ frame of the WB speech signal, for providing a filtered WB speech input;

c) a perceptual weighting and zero-input response subtraction module (12*b*), responsive to the filtered WB speech input, for providing a WB target signal $x_w(n)$ for the $n^{th}$ frame;

d) a band-splitting module (14), responsive to the WB target signal $x_w(n)$ for the $n^{th}$ frame, for splitting the WB target signal into a higher band (HB) and a lower band (LB), the band-splitting module for providing a lower-band (LB) target signal x(n) and an LB impulse response h(n);

e) an LB analysis-by-synthesis (A-b-S) filter (16), responsive to the LB target signal x(n) and the LB impulse response h(n), for providing an LB excitation exc(n);

f) a band-combining module (17), responsive to the LB excitation exc(n) and optionally to an additional signal serving as a higher band (HB) excitation $exc_h(n)$, for interpolating the LB excitation exc(n) to provide an interpolated LB excitation, and for optionally combining the interpolated excitation and the additional signal so as to provide a WB excitation $exc_w(n)$; and g) a WB LP synthesis filter (18), responsive to $\tilde{A}_w(z)$, and further responsive to the WB excitation $exc_w(n)$, for providing WB synthesized speech, and further for providing a zero-input memory update $MemSyn_w(n)$ useful for making a zero-input response subtraction;

thereby providing an LP encoding in which the sampling rate used for the search for an LB excitation exc(n) is less than the WB sampling rate used in the LP analysis and synthesis.

16. A system as claimed in claim 15, wherein the band-splitting module (14) further provides a higher-band (HB) target signal $x_h(n)$ and an HB impulse response $h_h(n)$, and wherein the system further comprises:

a) an HB A-b-S module (15), responsive to the HB target signal $x_h(n)$ and to the HB impulse response $h_h(n)$, for providing an HB excitation $exc_h(n)$;

and further wherein the band-combining module 17 is further responsive to the HB excitation $exc_h(n)$.

17. A system as claimed in claim 15, wherein the band-splitting module (14) determines the LB target signal x(n) and the LB impulse response h(n) by decimating the WB target signal $x_w(n)$ and WB impulse response $h_w(n)$ respectively, and wherein the band-combining module (17) includes a module for interpolating the LB excitation exc(n) to provide the WB excitation $exc_w(n)$.

18. A system as claimed in claim 15, wherein in decimating the WB target signal $x_w(n)$, a decimating delay is introduced that is compensated for by filtering the WB impulse response from the end to the beginning of the frame using a decimating low-pass filter that limits the delay of the decimating to one sample per frame, and wherein in interpolating the LB excitation exc(n), an interpolating delay is introduced that is compensated for by using an interpolating low-pass filter that limits the delay of the interpolating to one sample per frame.

19. A mobile terminal, including a system for encoding an $n^{th}$ frame in a succession of frames of a wideband (WB) speech signal, the system comprising:

a) a WB linear predictive (LP) analysis module (11) responsive to the $n^{th}$ frame of the wideband speech signal, for providing LP analysis filter characteristics;

b) a WB LP analysis filter (12*a*), also responsive to the $n^{th}$ frame of the WB speech signal, for providing a filtered WB speech input;

c) a band-splitting module (14), responsive to a WB target signal $x_w(n)$ determined from the filtered WB speech input for the $n^{th}$ frame, for splitting the filtered WB speech input into a plurality of bands, the band-splitting module for providing a lower band (LB) target signal x(n);

d) an excitation search module (16), responsive to the LB target signal x(n), for providing an LB excitation exc (n); and e) a band-combining module (17), responsive to the LB excitation exc(n) and optionally to an additional signal serving as a higher band (HB) excitation $exc_h(n)$, for interpolating the LB excitation exc(n) to provide an interpolated LB excitation, and for optionally combining the interpolated excitation and the additional signal so as to provide a WB excitation $exc_w(n)$.

20. A mobile terminal as claimed in claim 19, also including a system for decoding an $n^{th}$ encoded frame in a succession of encoded frames of a wideband (WB), the encoded frames each providing information indicating a lower band (LB) excitation exc(n) and linear predictive (LP) analysis filter characteristics, the system comprising:

a) an LB excitation construction module (22), responsive to information indicating the LB excitation exc(n), for providing the LB excitation exc(n);

b) a decoder band-combining module (23), for interpolating the LB excitation exc(n), for providing a WB excitation $exc_w(n)$; and c) a decoder WB LP synthesis filter (24), responsive to the LP analysis filter characteristics and to the WB excitation $exc_w(n)$, for providing WB synthesized speech.

21. A telecommunications network having a network element including a system for encoding an $n^{th}$ frame in a succession of frames of a wideband (WB) speech signal, the system comprising:

a) a WB linear predictive (LP) analysis module (11) responsive to the $n^{th}$ frame of the wideband speech signal, for providing LP analysis filter characteristics;

b) a WB LP analysis filter (12*a*), also responsive to the $n^{th}$ frame of the WB speech signal, for providing a filtered WB speech input;

c) a band-splitting module (14), responsive to a WB target signal $x_w(n)$ determined from the filtered WB speech input for the $n^{th}$ frame, for splitting the filtered WB speech input into a plurality of bands, the band-splitting module for providing a lower band (LB) target signal x(n);

d) an excitation search module (16), responsive to the LB target signal x(n), for providing an LB excitation exc (n); and e) a band-combining module (17), responsive to the LB excitation exc(n) and optionally to an additional signal serving as a higher band (HB) excitation $exc_h(n)$, for interpolating the LB excitation exc(n) to provide an interpolated LB excitation, and for optionally combining the interpolated excitation and the additional signal so as to provide a WB excitation $exc_w(n)$.

22. A telecommunications network as in claim 21, also having a network element that includes a system for decoding an $n^{th}$ encoded frame in a succession of encoded frames of a wideband (WB) speech signal, the encoded frames each providing information indicating a lower band (LB) excitation exc(n) and linear predictive (LP) analysis filter characteristics, the system comprising:

a) an LB excitation construction module (22), responsive to information indicating the LB excitation exc(n), for providing the LB excitation exc(n);

b) a decoder band-combining module (23), for interpolating the LB excitation exc(n), for providing a WB excitation $exc_w(n)$; and c) a decoder WB LP synthesis filter (24), responsive to the LP analysis filter characteristics and to the WB excitation $exc_w(n)$, for providing WB synthesized speech.

* * * * *